US006906478B2

(12) United States Patent
Hajima et al.

(10) Patent No.: US 6,906,478 B2
(45) Date of Patent: Jun. 14, 2005

(54) METHOD OF REDUCING THE POWER CONSUMPTION OF PRE-ACCELERATOR IN ENERGY-RECOVERY LINAC

(75) Inventors: Ryoichi Hajima, Naka-gun (JP); Eisuke Minehara, Naka-gun (JP); Ryoji Nagai, Naka-gun (JP)

(73) Assignee: Japan Atomic Energy Research Institute, Chiba-ken (JP)

( * ) Notice: Subject to any disclaimer, the term of this patent is extended or adjusted under 35 U.S.C. 154(b) by 0 days.

(21) Appl. No.: 10/634,796

(22) Filed: Aug. 6, 2003

(65) Prior Publication Data

US 2004/0212330 A1 Oct. 28, 2004

(30) Foreign Application Priority Data

Sep. 25, 2002 (JP) ..... 2002-278467

(51) Int. Cl.[7] ..... H05H 15/00
(52) U.S. Cl. ..... 315/503; 315/5.41; 315/5.42
(58) Field of Search ..... 315/5.41, 5.42, 315/5.46, 503, 505; 250/305, 396 R

(56) References Cited

U.S. PATENT DOCUMENTS 4,570,103 A * 2/1986 Schoen ..... 315/5.41
4,851,688 A * 7/1989 Trell ..... 250/396 R
5,680,018 A * 10/1997 Yamada ..... 315/500
6,407,505 B1 * 6/2002 Bertsche ..... 315/5.41
6,603,247 B1 * 8/2003 Seward ..... 313/231.31

OTHER PUBLICATIONS

Institute of Advanced Energy; Institute for Chemical Research, Kyoto University, "Proceedings of the 27th Linear Accelerator Meeting in Japan", Aug. 2002, Kyoto Japan, pp. 169–171.

* cited by examiner

*Primary Examiner*—Hoang V. Nguyen
*Assistant Examiner*—Jimmy Vu
(74) *Attorney, Agent, or Firm*—Banner & Witcoff, Ltd.

(57) ABSTRACT

A method of producing synchrotron radiation comprising the steps of accelerating and compressing an electron beam generated from an electron source by means of a pre-accelerator, further accelerating the electron beam in a main accelerator to produce synchrotron radiation on a recirculation orbit, decelerating the electron beam in the main accelerator to recover its energy and discarding it into a beam dump, said pre-accelerator being an energy-recovery pre-accelerator and posited before the main accelerator on said recirculation orbit so that it also performs energy recovery through beam deceleration, thereby reducing the rf power it is supplied with externally for beam acceleration.

2 Claims, 3 Drawing Sheets

$I_{dec}$ : DECELERATED BEAM'S CURRENT VECTOR
$I_{acc}$ : ACCELERATED BEAM'S CURRENT VECTOR
Vb : VOLTAGE VECTOR DUE TO ELECTRON BEAM
Vb' : ELECTRON BEAM'S VOLTAGE VECTOR DUE TO DETUNING
Vg : VOLTAGE VECTOR SUPPLIED FROM RF SOURCE
Vc : VOLTAGE VECTOR IN ACCELERATING CAVITY
Ψ : DETUNING ANGLE

METHOD OF REDUCING THE POWER CONSUMPTION OF PRE-ACCELERATOR IN ENERGY-RECOVERY LINAC

This application is based upon and claims the benefit of priority from Japanese Patent Application No. 2002-278467 filed Sep. 25, 2002, the entire contents of this application are incorporated herein by reference.

BACKGROUND OF THE INVENTION

This invention relates to the production of synchrotron radiation on a recirculation orbit of electron beam as accelerated by a radio-frequency (rf) accelerator, particularly to a method of reducing the rf power consumption by using an energy-recovery pre-accelerator.

The energy-recovery pre-accelerator is an rf accelerator by which an electron beam to be injected into the main accelerator is compressed and brought close to the speed of light so that it can be efficiently accelerated by the main accelerator. The present invention relates to a method of reducing the rf power that is supplied externally for beam acceleration by the pre-accelerator.

The rf accelerator is such equipment that a cavity is supplied with rf power to generate an rf electric field which is used to accelerate electron beams. Among the various types of rf accelerators proposed to date, an electron beam accelerator called an energy-recovery linac (ERL) is drawing increasing attention today. Being primarily intended for use as the next generation source of synchrotron radiation, ERL is most characterized by decelerating the once accelerated electron beam with the main accelerator on the recirculation orbit so as to recover the supplied rf power. As a result, the rf power input into the main accelerator can be drastically reduced despite the acceleration of the large-current electron beam.

As shown in FIG. 1, an electron beam generated from an electron source is accelerated and compressed by a conventional pre-accelerator and further accelerated by the main accelerator to produce synchrotron radiation on the recirculation orbit; thereafter, the electron beam is decelerated (has its energy recovered) in the main accelerator and discarded into a beam dump. Since energy recovery by deceleration is performed in the main accelerator, it can accelerate the large-current electron beam with a very small amount of power. This corresponds to an embodiment in which an electron beam from an electron source (injector) that has been brought to an energy of about 10 MeV and a length of about 3 ps with the conventional pre-accelerator is injected into the main accelerator on the recirculation orbit.

However, the conventional pre-accelerator which accelerates the electron beam does not perform energy recovery by deceleration, so it requires a very large amount of rf power (at least 100 kw) and hence an rf antenna (coupler) that withstands the large power input. This presents a substantial challenge in ERL construction. The rf antenna is needed to supply rf power into accelerating cavities in the rf accelerator.

SUMMARY OF THE INVENTION

The energy-recovery pre-accelerator of the present invention can be operated on a very small amount of rf power. The concept of the invention is depicted in FIG. 2; the energy-recovery pre-accelerator is posited on the recirculation orbit and the resonance frequency in an accelerating cavity in the pre-accelerator is slightly offset (detuned) from the input rf wave frequency, whereby the energy of the accelerated electron beam is recovered and the rf required by the pre-accelerator is brought sufficiently close to zero that the rf power to be supplied externally is reduced.

Thus, according to the invention, the power required for acceleration by the pre-accelerator is supplied from the electron beam being decelerated in the pre-accelerator; consequently, there is no need to supply rf waves of large power, obviating the aforementioned rf antenna compatible with the inputting of large power.

Conventionally, the main accelerator accelerates and decelerates an electron beam at a phase difference of 180 degrees. However, in the pre-accelerator which compresses the electron beam as well as accelerating it, the phase difference between beam acceleration and deceleration is not adjusted to 180 degrees and efficient energy recovery cannot be realized by simply positing the pre-accelerator on the recirculation orbit.

In the present invention, the energy-recovery pre-accelerator is posited on the recirculation orbit and, in addition, as FIG. 3 shows, the accelerating cavities in the pre-accelerator are detuned to effect phase manipulation such that the power consumption of the pre-accelerator is reduced drastically and easily.

DESCRIPTION OF THE PREFERRED EMBODIMENT

Figure 3:
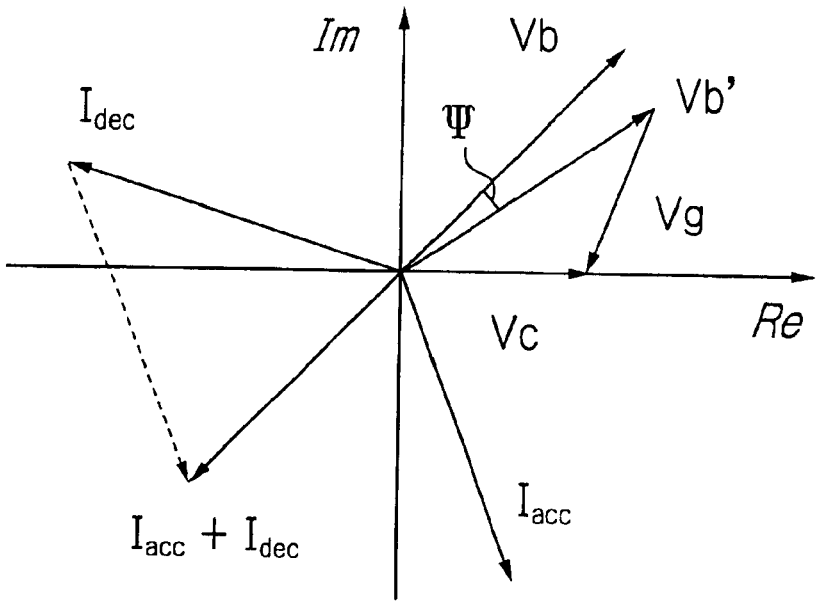
FIG. 3 is a power balance vector diagram for the energy-recovery pre-accelerator of the invention.

FIG. 3 is a power balance vector diagram for the energy-recovery pre-accelerator of the invention. The vectors drawn in FIG. 3 are complex vectors, with the complex plane being represented by the real axis (Re) and the imaginary axis (Im). If the accelerated electron beam Iacc (accelerated beam's current vector) is not offset in phase from the decelerated electron beam Idec (decelerated beam's current vector) by 180 degrees, a voltage vector Vb is created by the electron beams and the magnitude of Vb can be manipulated by the Q value of an accelerating cavity (i.e., the quantity representing the sharpness of resonance in the accelerating cavity). If the accelerating cavity is detuned from the rf wave by a detuning angle Ψ, a voltage vector Vb' created by the electron beams relative to the rf wave (i.e., the electron beam's voltage vector due to detuning) can be expressed by the following equation:

$$Vb' = Vb/\cos\Psi$$

Note that the detuning angle Ψ is the degree, expressed by phase angle, of a slight offset of the resonance frequency in the accelerating cavity relative to the frequency of the rf wave.

The voltage vector in the accelerating cavity Vc is expressed by the following equation:

$$Vc=Vb'+Vg$$

wherein Vg represents the voltage vector supplied from the rf source and can be adjusted to zero by appropriately choosing the Q value of the accelerating cavity and the detuning angle Ψ. FIG. 3 is a diagram for the case where the Q value and the detuning angle are chosen such that Vg assumes the same value whether electron beams are present or not.

Figure 4:
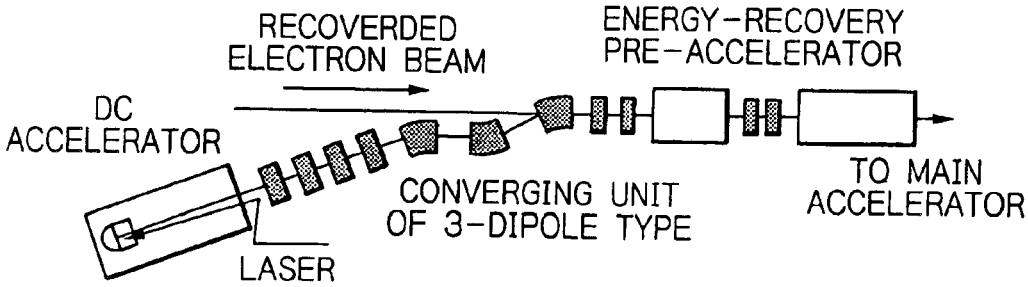
FIG. 4 shows configurations of a dc accelerator, a converging unit and a pre-accelerator in a specific embodiment of the invention.
Figure 5:
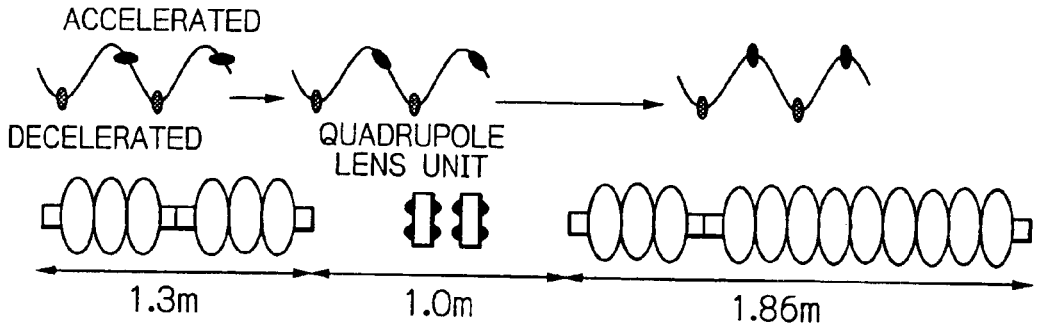
FIG. 5 shows a more specific configuration of the pre-accelerator in relation to the position of an accelerated or decelerated electron beam.
Figure 6:
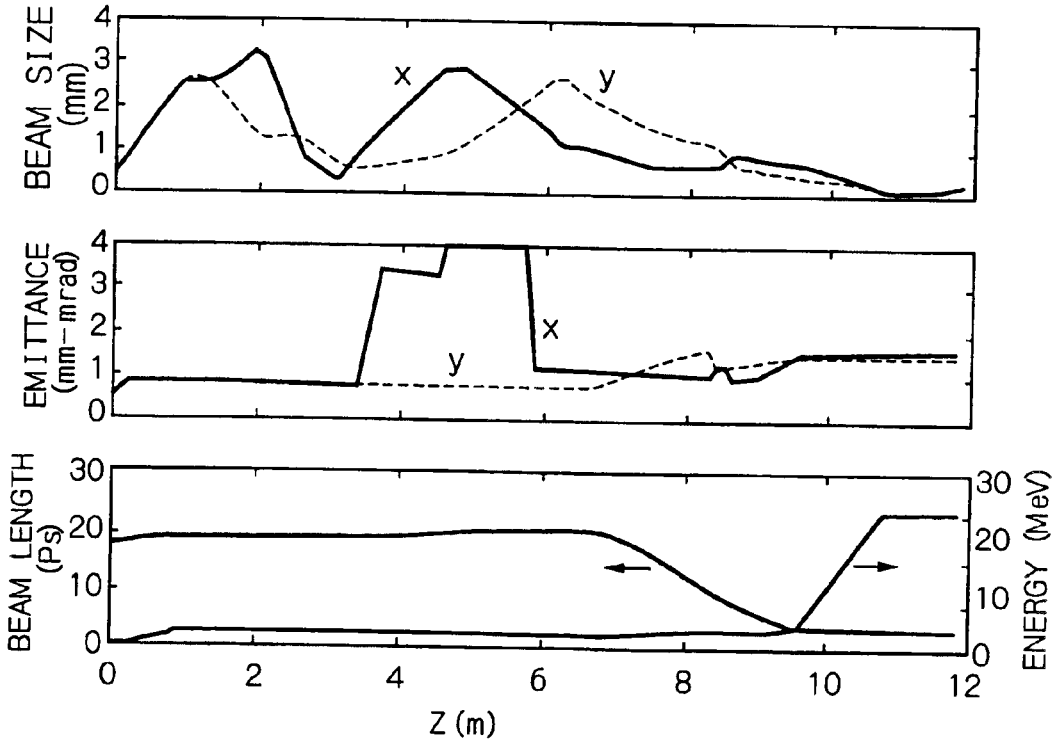
FIG. 6 is a set of graphs illustrating the results of calculations of beam dynamics in the specific embodiment of the invention.

An exemplary design of the energy-recovery pre-accelerator is depicted in FIGS. 4, 5 and 6 as a specific example of the invention. The electron gun uses a GaAs cathode, having an electron beam length of 17 ps (rms), a charge capacity of 77 pC, a repetition rate of 1.3 GHz, an average current of 100 mA and an anode voltage of 250 kV. The dc accelerator has an acceleration field of 2 MV/m and a voltage of 2 MV. The converging unit is of a three-dipole type with a deflection angle of 15 degrees, a curvature radius of 1 m and a magnet-to-magnet distance of 0.82 m. The pre-accelerator operates at 1.3 GHz and has a 3-cell cavity× 3+9-cell cavity×1 configuration, with an acceleration voltage per cavity of 1.2 MV (for 3-cell cavity) and 20 MV (for 9-cell cavity) and $Q_0=5\times10^9$.

As shown in FIG. 4, the converging unit of 3-dipole type consists of three deflecting solenoids (dipoles). The combination of three deflecting solenoids can cancel the chromatic aberration of an electron beam.

The results of calculating beam dynamics with numeric calculating codes are shown in FIG. 6. The electron beam obtained had an energy of 23 MeV, a normalized emittance of 1.5 mm-mrad in both x- and y-directions and a beam length of 3.3 ps. This was satisfactory as the performance required of the pre-accelerator in ERL which is employed as a source of synchrotron radiation.

The rf power balance in the case under consideration can be determined from the currents and phases of the accelerated and decelerated beams, as well as from the Q value and detuning angle of an accelerating cavity under load. As shown in FIG. 5, the phase difference between the accelerated and decelerated beams is not 180 degrees in a 3-cell cavity. However, the vector sum of the two beams is decelerating, so by judicious choice of the Q value and detuning angle, one can achieve complete energy recovery and the consumption of radio-frequency power can be adjusted to substantially zero. However, since the optimum detuning angle for the case where rf power is supplied and an electron beam is accelerated differs from the optimum value for the case where rf power is supplied but no electron beam acceleration is performed, a certain measure such as high-speed detuning must be taken in actual operation. For the purposes of the present discussion, the detuning angle was so set that equal amounts of rf power would be consumed in both cases and a comparison between the power consumption of the energy-recovery pre-accelerator and that of the conventional pre-accelerator is shown below in Table 1. Thus, the power consumption of the energy-recovery pre-accelerator could be reduced to less than a tenth of the power consumption of the conventional pre-accelerator without performing high-speed detuning.

TABLE 1

Comparison of Energy Consumption Between Energy-Recovery and Conventional Pre-accelerators

| Cavity No. | Power Consumption of Conventional Pre-accelerator | Power Consumption of Energy-Recovery Pre-accelerator |
|---|---|---|
| 1 | 120 kW | 9.9 kW |
| 2 | 120 kW | 6.2 kW |
| 3 | 120 kW | 1.8 kW |

FIGS. 4, 5 and 6 are further explained below. FIG. 4 shows that an electron beam injected from the 2 Mev dc accelerator is brought to 23 MeV by the energy-recovery pre-accelerator. Stated specifically, the electron gun in the dc accelerator is illuminated with a laser to generate a 2 Mev electron beam, which passes through the converging unit of 3-dipole type consisting of three deflecting solenoids and converges with the recovered electron beam on the recirculation orbit. The convergent electron beam is accelerated and compressed in the energy-recovery pre-accelerator and the resulting 23 MeV electron beam is pushed into the main accelerator. At the same time, the recovered electron beam is decelerated and its energy is recovered. This contributes to a drastic reduction in the power consumption of the pre-accelerator.

FIG. 5 is a diagram showing the configuration of the energy-recovery pre-accelerator and the position of an electron beam in relation to the phase of rf waves. Consisting of three 3-cell cavities, one 9-cell cavity and a quadrupole lens unit, the pre-accelerator compresses a 17-ps long electron beam to 3.3 ps and brings it to 23 MeV as it recovers the beam's energy. In other words, the energy-recovery accelerator accelerates an electron beam as its energy is recovered during deceleration.

We now explain the energy recovery and beam acceleration that are performed by the energy-recovery pre-accelerator. As shown in FIG. 5, an rf electric field varies sinusoidally with time. If an electron beam is injected when the sinusoidal field is positive, beam acceleration occurs, namely, the energy of the rf wave is transferred to the electron beam. Conversely, if an electron beam is injected when the sinusoidal field is negative, beam deceleration occurs. If the accelerated beam is 180° out of phase with the decelerated beam, the power required for acceleration and that for deceleration balance out, enabling a beam of large-current power to be accelerated with a very small amount of power.

Figure 1:
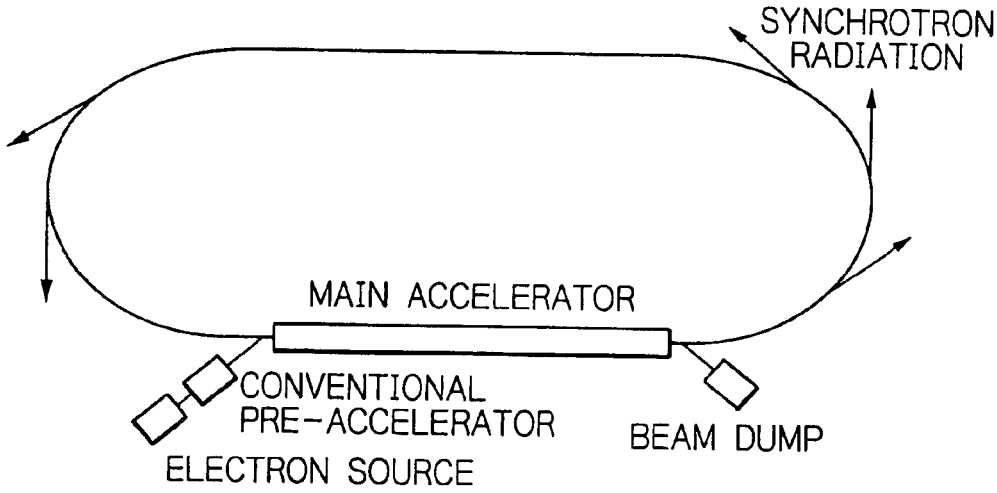
FIG. 1 shows a configuration of an energy-recovery linac that employs a conventional pre-accelerator.

Relying upon this principle, the main accelerator was conventionally posited on the recirculation orbit in the energy-recovery linac (ERL) as depicted in FIG. 1 and this enabled acceleration of a large current with small rf power.

Figure 2:
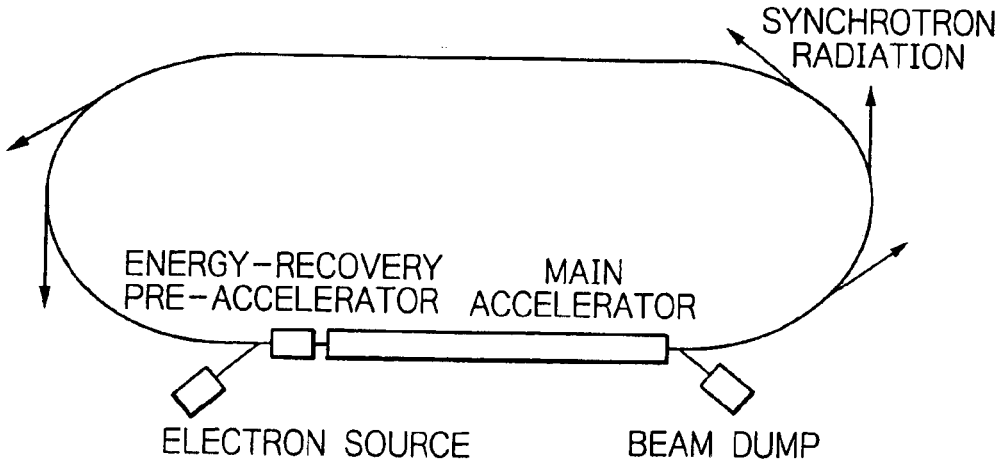
FIG. 2 shows a configuration of an energy-recovery linac that employs the energy-recovery pre-accelerator of the invention.

According to the invention, as shown in FIG. 2, the pre-accelerator is also posited on the recirculation orbit and energy recovery is effected in order to reduce the power consumption of the pre-accelerator. However, as shown in FIG. 5, the phase difference between accelerated and decelerated beams is not 180 degrees in the pre-accelerator, so by means of phase manipulation which consists of slightly offsetting (detuning) the resonance frequency of the accelerating cavity from the frequency of rf waves, the power required for beam acceleration and that for deceleration are caused to balance out, thereby ensuring that the electron beam can be accelerated and compressed with a very small amount of rf power not only in the main accelerator but also in the pre-accelerator.

FIG. 6 is a set of graphs showing the results of calculating beam dynamics in the specific preferred embodiment of the invention. Emittance plotted on the vertical axis of the center graph is a quantity that represents the quality of an electron beam. It may be normalized with energy and the smaller the value of this "normalized emittance", the higher the quality of the electron beam. The top graph shows that by passage through the energy-recovery pre-accelerator, beam size progressively decreases in both x- and y-directions. The center graph shows that emittance eventually levels off at 1.5 mm-mrad in both x- and y-directions. The bottom graph shows that eventually beam length becomes 3.3 ps and beam energy 23 MeV.

In the present invention, an energy-recovery linac is used as a pre-accelerator and posited before the main accelerator on the recirculation orbit so that energy recovery by beam deceleration is realized not only in the main accelerator but also in the pre-accelerator, thereby ensuring that the pre-accelerator also requires a reduced amount of rf power for beam acceleration.

What is claimed is:

1. A method of producing synchrotron radiation comprising the steps of accelerating and compressing an electron beam from an electron source by means of a pre-accelerator, further accelerating the electron beam in a main accelerator to produce synchrotron radiation on a recirculation orbit, decelerating the electron beam in the main accelerator to recover its energy and discarding it into a beam dump, said pre-accelerator being an energy-recovery pre-accelerator and posited before the main accelerator on said recirculation orbit, and a resonance frequency in an accelerating cavity in the pre-accelerator is slightly offset from a input radio-frequency wave frequency, whereby an energy of the accelerated electron beam is recovered in the pre-accelerator and a radio-frequency required by the pre-accelerator is brought sufficiently close to zero that a radio-frequency power to be supplied externally is reduced.

2. The method according to claim 1, wherein the main and pre-accelerators are each a radio-frequency accelerator.

* * * * *